United States Patent [19]

Hood et al.

[11] Patent Number: 4,676,559

[45] Date of Patent: Jun. 30, 1987

[54] TOWEL DISPENSER

[75] Inventors: Oliver S. Hood; Brendan McGrath, both of Dublin, Ireland; Juha Myllarinen, Pirkkala, Finland

[73] Assignee: Nokia Limited, Dublin, Ireland

[21] Appl. No.: 861,175

[22] Filed: May 9, 1986

[51] Int. Cl.[4] ..... B65H 19/00

[52] U.S. Cl. ..... 312/39; 312/37; 312/38

[58] Field of Search ..... 312/37, 38, 39, 40, 312/41, 236; 242/55.3, 55.53

[56] References Cited

U.S. PATENT DOCUMENTS

| | | | |
|---|---|---|---|
| 2,229,327 | 1/1941 | Hepner et al. | 312/38 |
| 2,871,078 | 1/1959 | Carleo | 312/39 |
| 2,930,663 | 3/1960 | Weiss | 312/38 |
| 3,323,848 | 6/1967 | Bahnsen | 312/38 |
| 3,853,363 | 12/1974 | Frederiksen | 312/38 |
| 3,893,738 | 7/1975 | Bahnsen | 312/38 |
| 4,170,390 | 10/1979 | McCabe | 312/37 |
| 4,358,169 | 11/1982 | Filipowicz et al. | 312/39 |
| 4,448,462 | 5/1984 | Smith | 312/37 |
| 4,507,942 | 4/1985 | Hirose et al. | 312/236 |
| 4,573,750 | 3/1986 | Golby | 312/39 |

*Primary Examiner*—Victor N. Sakran

*Attorney, Agent, or Firm*—Sughrue, Mion, Zinn, Macpeak and Seas

[57] ABSTRACT

A towel dispenser for dispensing a towel loop so that the planes of the exit leg and the return leg of the loop are substantially in line with the user. The towel dispenser comprises a housing having front and rear walls and joined by a top wall and a base. The housing is adapted for mounting so that the rear wall is adjacent the wall or other structure on which the dispenser is mounted. A towel outlet and inlet slot are provided in the base and extend between the front and rear walls. A skid plate supports a clean towel roll which is dispensed between a drive and pinch roller. A take up roller winds up used towel. When not in use, the towel loop is substantially completely withdrawn into the housing.

20 Claims, 33 Drawing Figures

Fig. 10
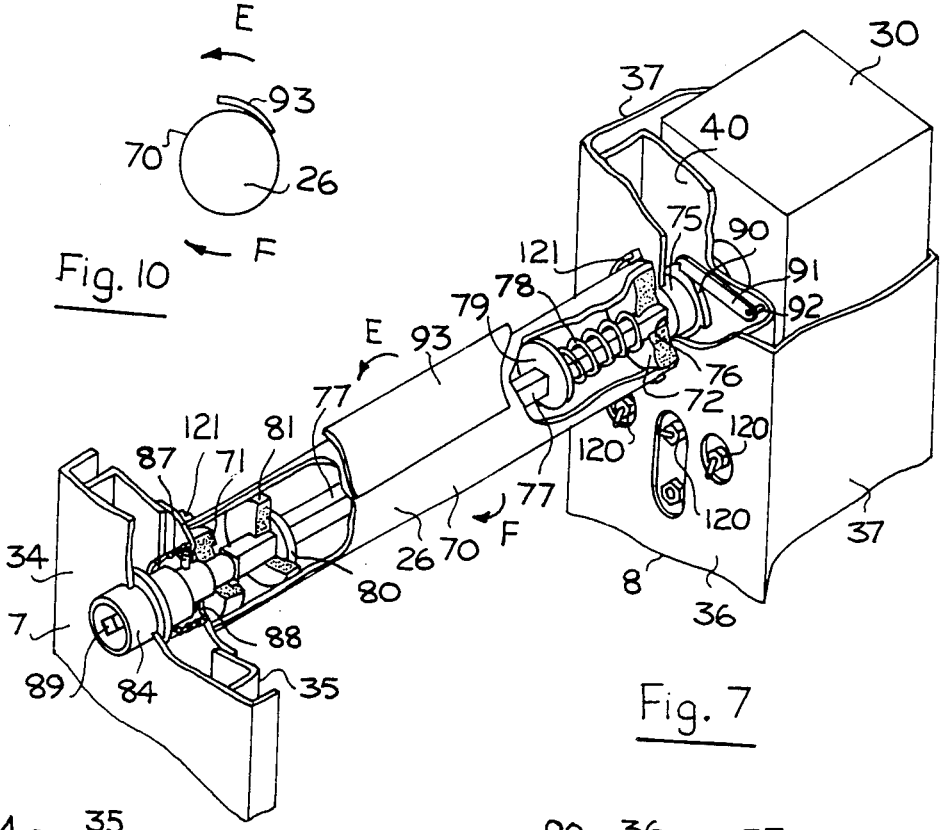
Fig. 7
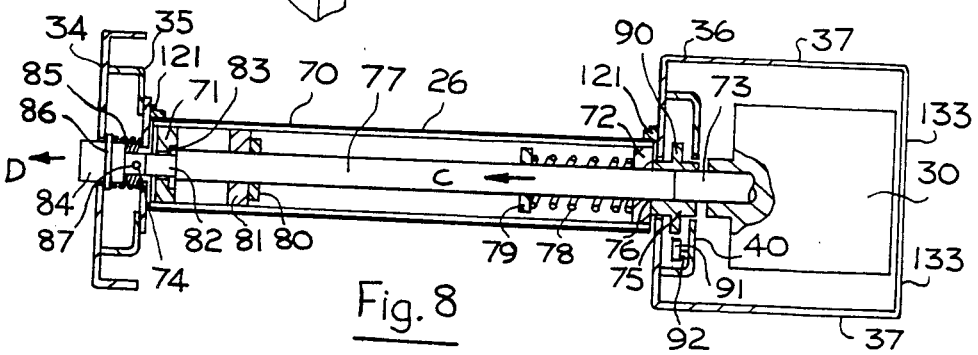
Fig. 8
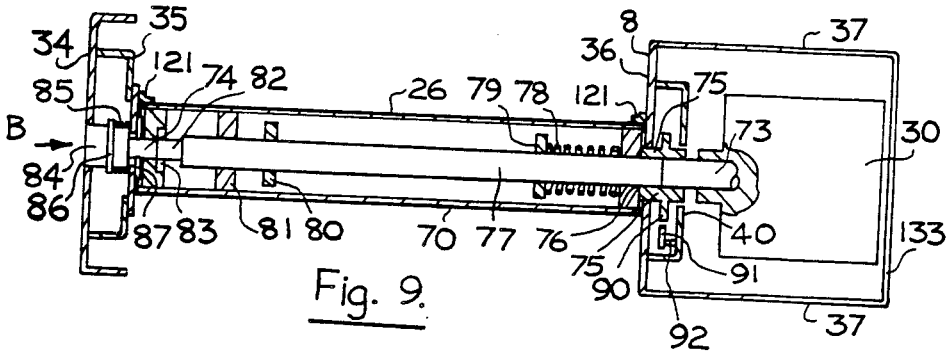
Fig. 9

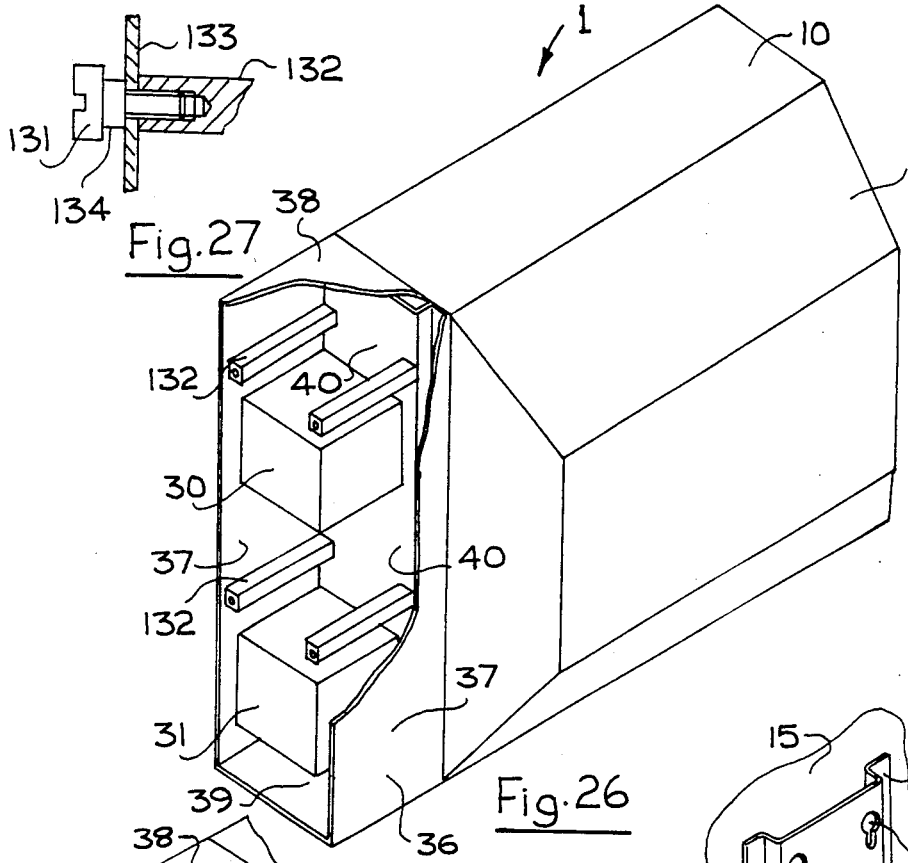
Fig.27
Fig.26
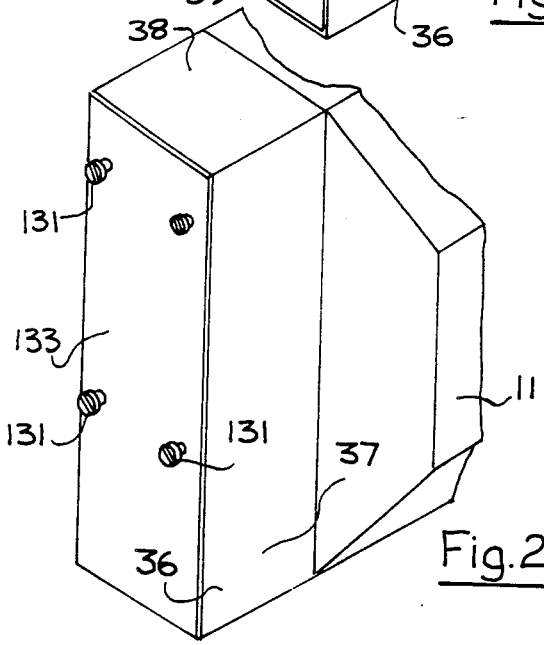
Fig.25
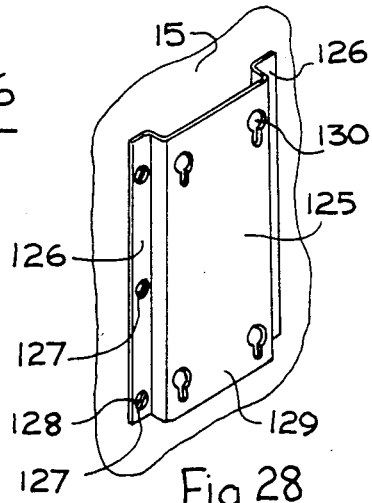
Fig 28

TOWEL DISPENSER

FIELD OF THE INVENTION

The present invention relates to a towel dispenser of the type for dispensing a continuous towelling web in the form of a loop of towel having an exit leg extending from a dispenser outlet and a return leg extending into the dispenser inlet.

BACKGROUND TO THE INVENTION

Known towel dispensers generally comprise a housing with a towel outlet, usually arranged at the front of the housing, and a towel inlet usually arranged at the rear of the housing. The towel loop depends from the outlet and the inlet. A storing means is provided in the housing to store a clean towel roll and a dispensing means usually provided by a drive and pinch roller dispense towel from the clean towel roll through the outlet. A take up means usually provided by a roller onto which the used towel is wound takes up used towel from the towel loop. In general, when one pulls on the exit leg of the towel loop from the outlet, fresh towel is fed out by the dispensing rollers. A drive connecting mechanism between the dispensing rollers and the take up roller normally takes up an equivalent length of used towel onto the take up roller.

In the case of some such dispensers, the towel loop is left continuously exposed. In other cases, such as for example, in British Patent specification No. 1460177 the towel loop is withdrawn into the housing after use.

However, the problem with all these known towel dispensers is that they all present the towel to the user such that the plane of the exit leg and return leg are effectively facing the user. This presents two major problems. Firstly, to dry ones hands it is generally only possible to use one leg of the towel, namely, the exit or front leg. It is usually not possible to grip both legs of the towel between the hands for drying or to use the rear leg. Thus, a considerable length of unused towel is withdrawn into the housing after each use. This leads to considerable wastage. The second and more important problem is that to dry ones hands properly, it is necessary to put one hand behind the exit leg of the towel loop and the other in front of it, and then to twist the towel through substantially 90°. This makes it particularly difficult for one to dry ones hands and by virtue of the fact that the towel has to be twisted through 90°, the effective length of the towel for use is considerably shortened. Furthermore, when the exit or front leg of the towel is being used, the return or exit leg, in general, gets in the way.

OBJECTS OF THE INVENTION

One object of the invention is to provide a towel dispenser which dispenses towel from a towel roll, which overcomes the problems of dispensers known heretofore. It is also an object of the invention to provide a towel dispenser which permits the user to use both the exit and return legs of the towel loop either separately or simultaneously. It is another object of the invention to provide a dispenser which reduces wastage of towel which is a problem with dispensers known heretofore. A further object of the invention is to provide a towel dispenser which avoids the need for a user to turn the towel through 90° for use. Another object of the invention is to provide a dispenser in which the used towel roll can readily easily be removed. It is also an object of the invention to provide a used towel roller which can readily easily be disengaged from the used towel roll. A further object of the invention is to provide a towel dispenser in which the towel, when not in use, is taken up into the housing.

SUMMARY OF THE INVENTION

According to the invention there is provided a towel dispenser of the type for dispensing a continuous towelling web in the form of a loop, having an exit leg extending from the dispenser, and a return leg extending into the dispenser, the towel dispenser comprising a housing having a towel outlet and a towel inlet, storing means in the housing to store a clean towel roll, dispensing means in the housing to dispense the towel through the outlet, take up means in the housing to take up used towel into the housing through the inlet, wherein the towel outlet and towel inlet are arranged so that, in use, the plane of each leg of the towel loop is substantially in line with the user.

In one embodiment of the invention the housing comprises a front and rear wall, the rear wall being adapted, in use, for mounting adjacent a wall or other structure, the towel oulet and inlet being provided by elongated slots extending between the front and rear walls.

Preferably, in use the plane of each towel leg is substantially perpendicular to the wall or other structure.

In another embodiment of the invention, the take up means takes up substantially all of the used towel loop into the housing after use.

Preferably, take up means is provided by a take up roller releasably mounted in the housing, drive means being provided to drive the take up roller.

Advantageously, the drive means is an electrically powered motor and keying means releasably connects one end of the take up roller to the motor shaft, a stub shaft in the front wall releasably and rotatably engaging the other end of the take up roller.

In a further embodiment of the invention, the keying means is provided by an elongated keying member coaxial with and slidable longitudinally in the take up roller, and movable from a position within the roller to a position extending from the roller to engage an axial recess in the motor shaft.

Preferably, the stub shaft is movable longitudinally to rotatably engage a bore in the take up roller, and to engage the keying member so that as the stub shaft engages the bore, the keying member is urged to engage the motor shaft.

Advantageously, locating means are provided on the front and rear wall to locate the take up roller prior to interengaging of the keying means.

In another embodiment of the invention, engagement means are provided on the take up roller to engage the towel for winding on, the engagement means being arranged so that on rotation of the take up roller in one direction, the towel is gripped by the roller, while slight slackening in the other direction permits the roller to be withdrawn from the towel roll. Preferably, the engagement means are provided by at least one member extending tangentially from the circumference of the take up roller in a radial circumferential direction.

In a further embodiment of the invention, trip means are provided to deactivate the take up means, the trip means being responsive to tension in the towel between the dispensing means and the take up means.

In another embodiment of the invention, the dispensing means is provided by a co-operating drive and pinch roller to dispense the towel therebetween, and a monitoring means to monitor when a predetermined length of towel has been dispensed is provided. Preferably, the storing means comprises a skid plate mounted in the housing for supporting a clean towel roll in rolling rotation.

Alternatively, engagement means are provided on the dispensing means to engage the towel. Preferably, the dispensing means is provided by a drive roller, the engagement means being provided by a plurality of teeth extending at least partly around the drive roller.

In another embodiment of the invention, the towel loop extends in use into an enclosed compartment having an opening to provide access to the towel loop.

In a further embodiment of the invention a mechanically operated activating switch to activate the dispenser is mounted in the housing, an access opening being provided in a wall of the housing to allow access to the switch, guide means being provided in the housing to guide the towel between the switch and the housing wall adjacent the access opening.

In a further embodiment of the invention, a warm air generating means is provided to blow warm air at or adjacent the towel loop in use.

Additionally, the invention provides a towel for use in the dispenser, the towel roll being formed by a continuous towelling web, the web comprising a plurality of openings to engage corresponding engagement means on the drive roller.

Further, the invention provides a method for dispensing a continuous towelling web from a towel dispenser in the form of a towel loop, the towel loop having an exit leg extending from the dispenser and a return leg extending into the dispenser, in which the method includes the step of dispensing the towel from the dispenser so that the plane of each leg of the towel loop is substantially in line with the user.

ADVANTAGES OF THE INVENTION

The advantages of the invention are many. One of the most important advantages of the invention is that by virtue of the fact that the towel loop is dispensed from the inlet and the outlet with the planes of each leg of the loop substantially in line with the user, the user need merely put one hand on each side of the towel loop, grasp it between his hands and commence to dry. This eliminates the need to twist the towel through 90°, which has been a problem of towel dispensers known heretofore. A particular advantage of this is that the user can use both legs of the towel to dry his hands, thereby providing more absorbency. This also, it will be appreciated, reduces the amount of waste which has been a feature of dispensers known heretofore, since both the exit and return leg of the towel are used to dry the hands. Needless to say, if desired, the user can put one hand between each leg, and merely use one let to dry the excess moisture from his hands, and then finish off with the second leg.

Another advantage of the invention is that by virtue of the fact that the dispenser withdraws the used towel loop substantially completely into the housing, the unsightly dirty towel loop depending from the dispenser which has been a feature of most dispensers known heretofore is eliminated. This further reduces on wastage of the towel, since the user will be provided with a fresh towel loop for himself. One of the problems of towel dispensers known heretofore has been that a user very often pulls down a fresh loop when he is finished, and a subsequent user, not knowing whether the loop presented to him is fresh or not, usually pulls down a second loop.

A further advantage of the invention is that by virtue of the fact that the take up roller is releasably mounted in the housing, the used towel roll can readily easily be removed from the dispenser. Furthermore, by virtue of the fact that engagement means are provided on the take up roller, by rotating the take up roller in a particular direction it can readily easily be disengaged from the used towel roll. A further advantage of the invention is that by virtue of the fact that locating means are provided in the housing to locate the take up roller, it can readily easily be mounted in the housing.

A further advantage of the invention is that by virtue of the fact that a plate member is provided to form two compartments, one for the used towel roll, and one for the clean towel roll, both can be separated from each other which avoids contamination of the clean towel roll.

The advantage of providing teeth as an engagement means on the drive roller to engage the towel is that a positive drive is provided between the towel and the drive roller, and thus the possibility of slip between both is eliminated.

These and other advantages and objects of the invention will be readily apparent to those skilled in the art from the following description of some preferred embodiments thereof, which are given by way of example only with reference to the accompanying drawings.

BRIEF DESCRIPTION OF THE DRAWINGS

FIG. 7 is a cut away perspective view of portion of the towel dispenser of FIG. 1, FIG. 8 is a sectional view of portion of the towel dispenser of FIG. 1, FIG. 9 is a sectional view of the portion of FIG. 7 in a different position;

FIG. 10 is an end view of portion of the towel dispenser of FIG. 1,

FIG. 25 is a perspective view of a further detail of the dispenser of FIG. 1, FIG. 26 is a partly cut away perspective view of the detail of FIG. 25, FIG. 27 is a sectional view of portion of the detail of FIG. 25, FIG. 28 is a perspective view of a further portion of the detail of FIG. 25.

DETAILED DESCRIPTION OF THE INVENTION

Figure 1:
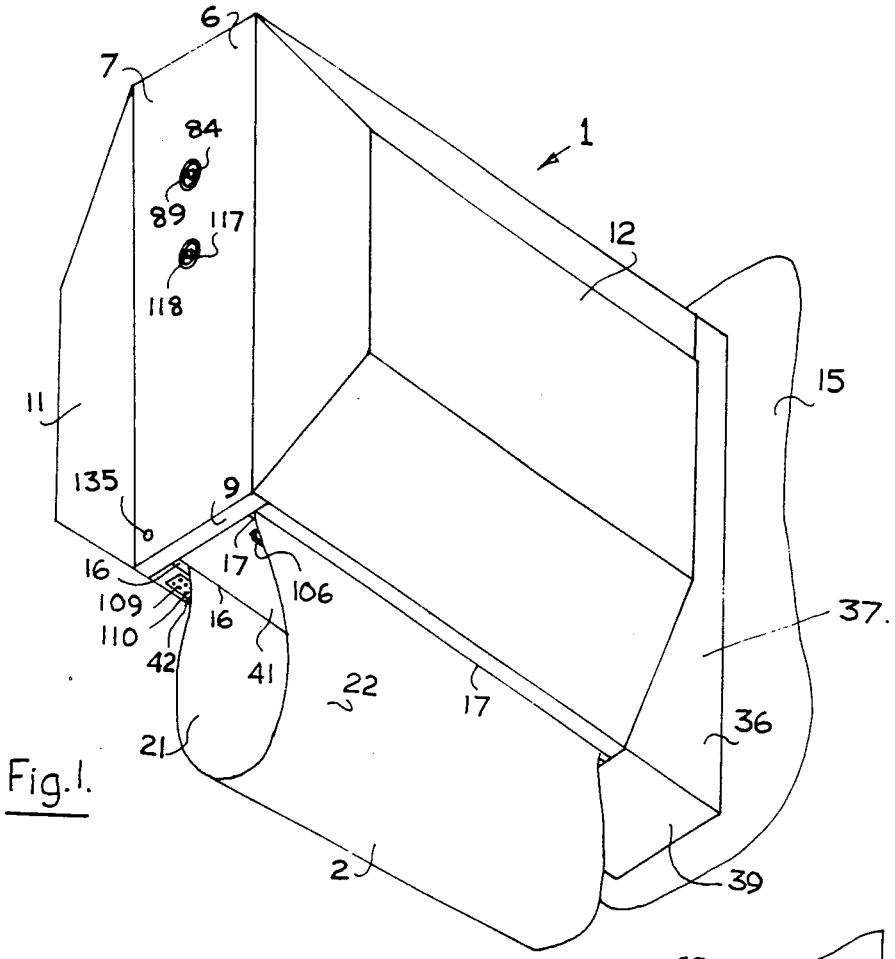
FIG. 1 is a perspective view of a towel dispenser according to the invention.
Figure 17:
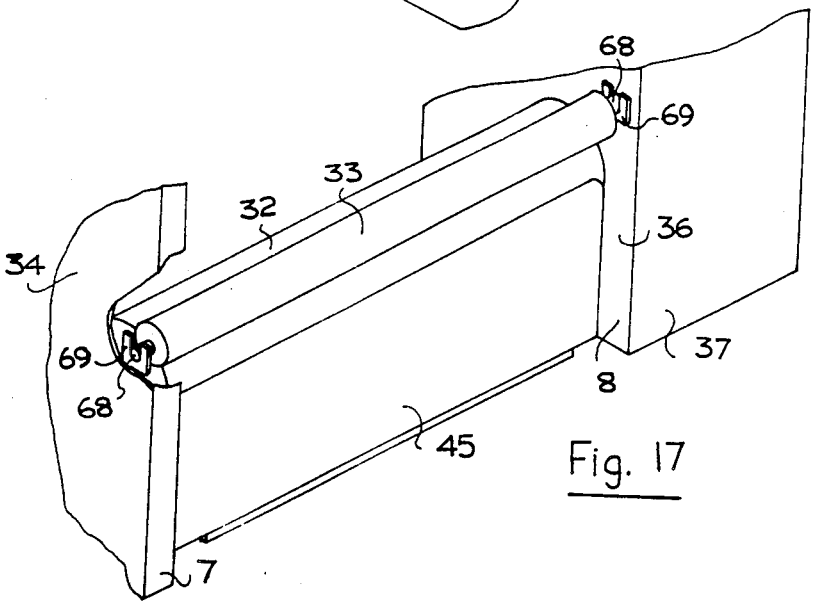
FIG. 17 is a perspective view of another portion of the dispenser of FIG. 1.
Figure 2:
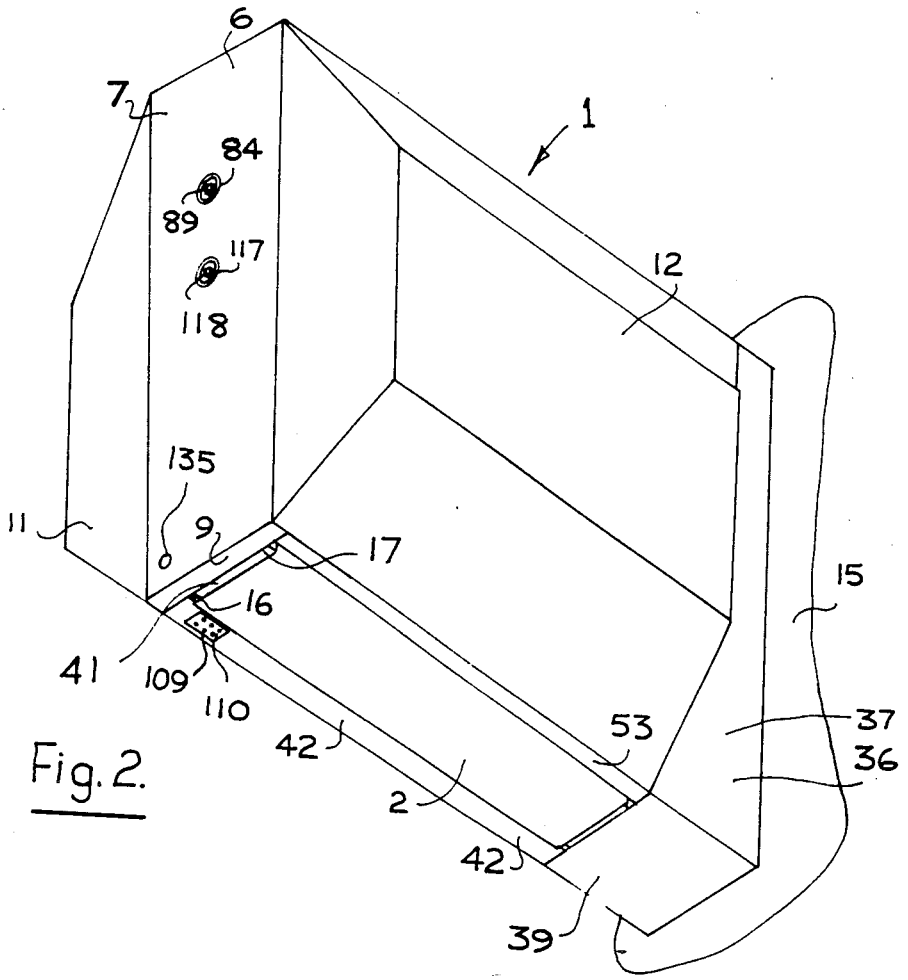
FIG. 2 is another perspective view of the towel dispenser of FIG. 1.
Figure 21:
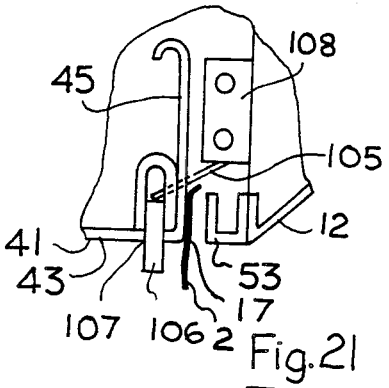
FIG. 21 is an elevational view of a portion of the dispenser of FIG. 1.
Figure 29:
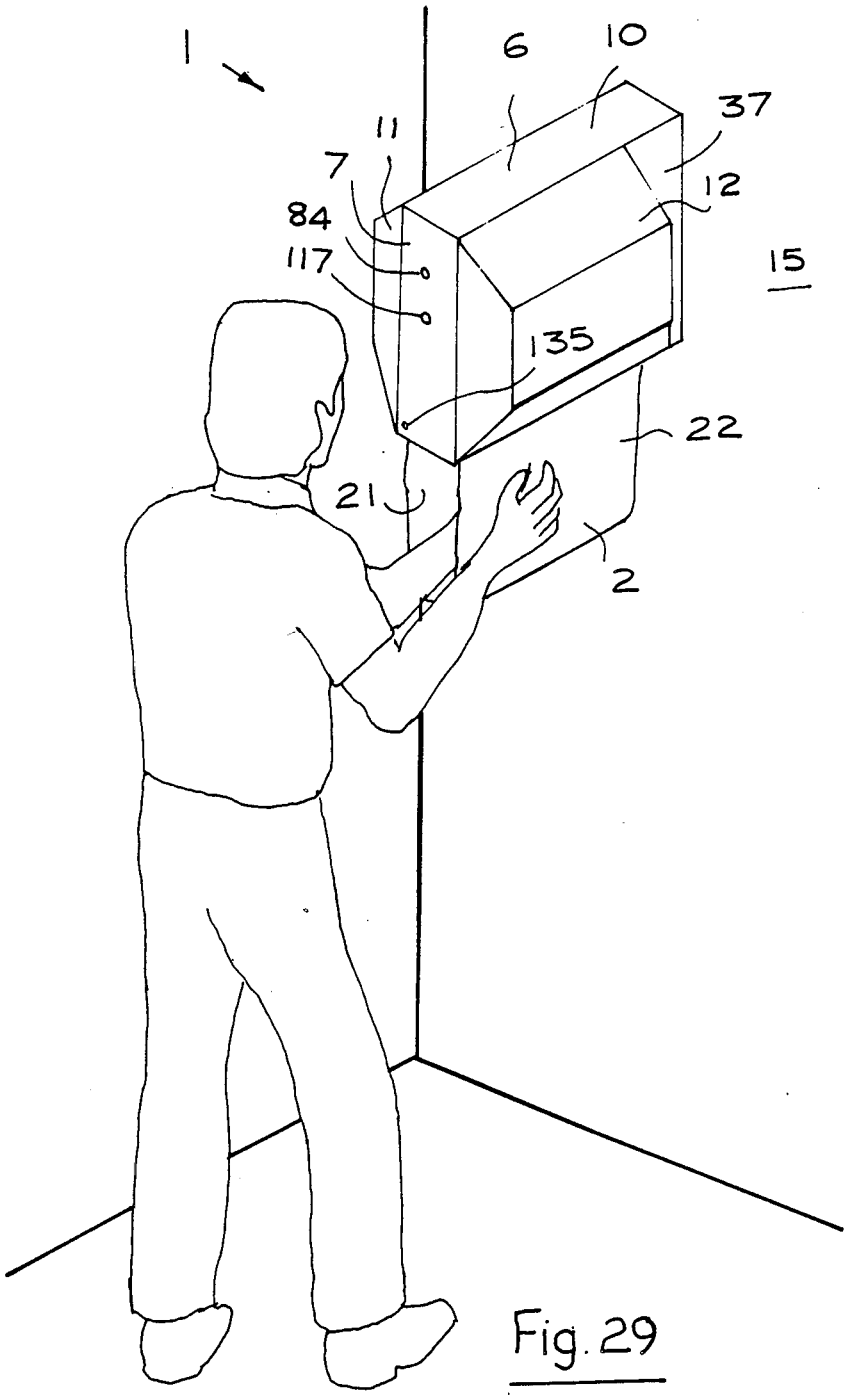
FIG. 29 is a perspective view of the dispenser of FIG. 1 in use.

Referring to the drawings and initially to FIGS. 1 to 29 there is provided a towel dispenser according to the invention, indicated generally by the reference numeral 1, for dispensing a towel loop 2 from a clean towel roll 3. The dispenser 1 comprises a housing 6 having a front wall 7 and a rear wall 8 joined by a base 9 and a top wall 10. A pair of side panels 11 and 12 hinged at 14 close the housing 6. As can be seen in FIGS. 1, 2 and 29 the housing is adapted for mounting to a wall 15 or any other construction, so that the rear wall 8 is substantially adjacent the wall 15. The mounting means for mounting the housing is described below.

Towel from the towel roll 3 is dispensed through an outlet slot 16 at one side of the base 9, while an inlet slot 17 at the other side of the base 9 accommodates return of a used towel loop 3. As will be described below the slot 16 is formed in the base, while the slot 17 is formed between an edge 19 of the base 8 and an edge 20 of the side panel 12. The slots 16 and 17 extend substantially from the rear wall 8 to the front wall 7 and thus, in use, a towel loop 2 is dispensed, so that its exit leg 21 and return leg 22 are substantially perpendicular to the wall 15 and in line with a user, see FIG. 29. The advantage of this is that the user, by standing in front of the dispenser 1, can place his hands, one on each side of the towel loop 2, and dry his hands, without the need for twisting the towel through 90°, as has been the case in towel dispensers known heretofore. Furthermore, the user, if desired, can place one hand between each of the legs 21 and 22 of the towel loop 2, and dry his hands in one leg only, if desired, see FIG. 29. The advantage of this is that the user could use one leg for drying excess moisture from his hands and use the second leg for finishing off. When the towel is not in use, it is withdrawn into the housing as illustrated in FIGS. 2 and 6.

A means to store the towel roll 3 is provided by a skid plate 24 extending between the front and rear walls 7 and 8. The towel roll 3 is rollably rotatable on the skid plate 24. A take up means, to take up a used towel loop 2, is provided by a take up roller 26 releasably engageable in the housing as will be described below. Means to dispense the towel loop 2 from the towel roll 3 is provided by a drive roller 32 cooperating with a pinch roller 33 rotatable in the front and rear walls 7 and 8. Drive means provided by electrically powered motors 30 and 31 drive the take up roller 26 and drive roller 32 respectively, as will be described in detail below.

Control circuitry, (not shown) controls the operation of the device. It is not intended to describe the electrical circuitry in any detail, as such circuitry will be well known to those skilled in the art.

Figure 6:
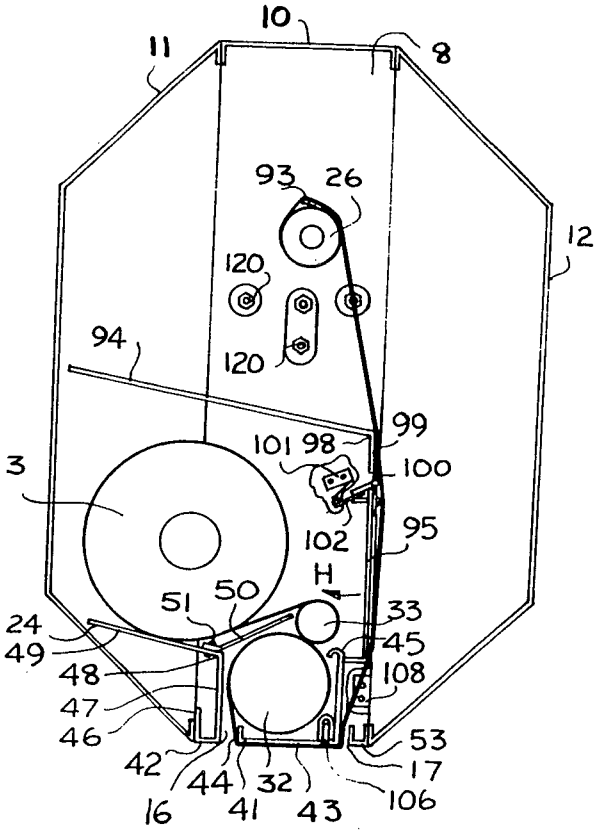
FIG. 6 is a sectional end view of the towel dispenser of FIG. 1 illustrating the towel in a different position.

Returning now to the housing 6, as can be seen in FIG. 6, the front wall 7 comprises an outer panel 34 of channel shaped construction, and an inner panel 35 also of channel shape construction, secured to the outer panel 34 by welding. The rear wall 8 is formed from a member 36 of channel shaped construction, having a pair of side walls 37 joined by a web which forms the rear wall 8. The side walls 37 extend rearwardly and mounting means described below are provided for mounting the side walls 36 to the wall 15 or other structure. The top wall 10 extends at 38 to close off the top end of the channel member 36, see FIG. 3. An end wall 39 closes off the bottom end of the channel member 36, see FIG. 4. Thus, the channel member 36 forms a housing for mounting the various control apparatus for the dispenser. A support plate 40 of channel section is mounted within the channel member 36 and secured to the rear wall 8 by screws (not shown). The motors 30 and 31 are mounted on the support plate 40 and the electronic control circuitry (not shown) for controlling the dispenser is also mounted on the support plate 40.

Figure 5:
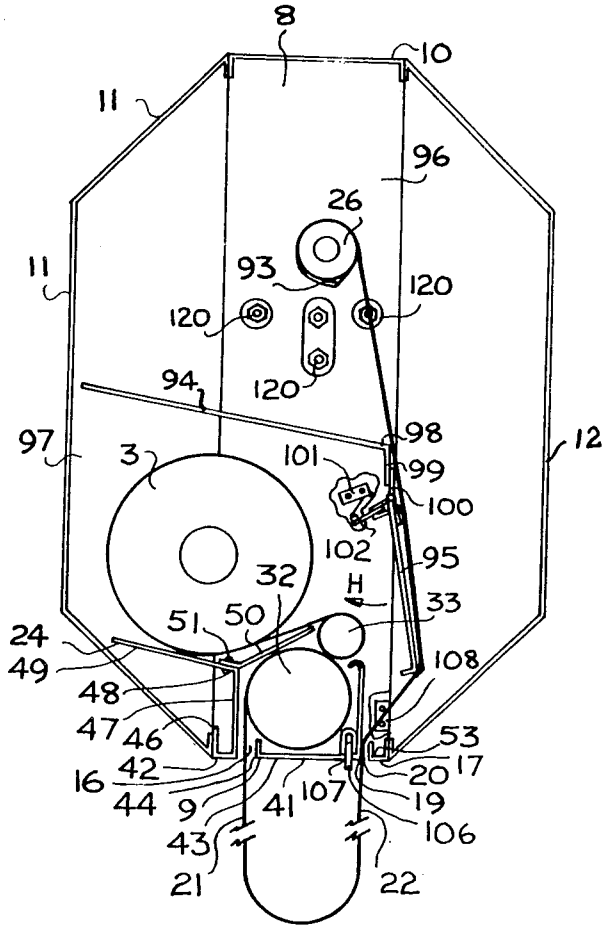
FIG. 5 is a sectional end view of the towel dispenser of FIG. 1.
Figure 11:
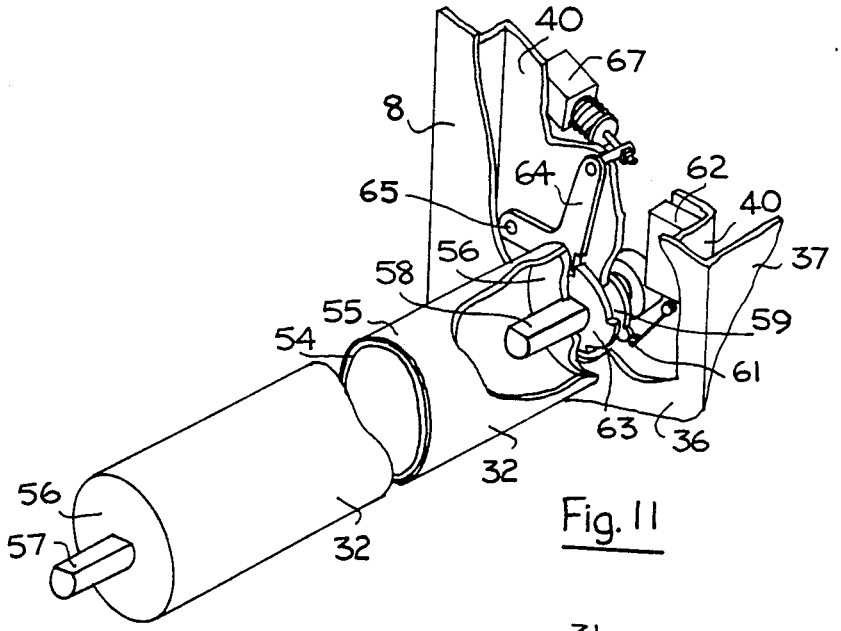
FIG. 11 is a perspective view of another portion of the dispenser of FIG. 1.
Figure 12:
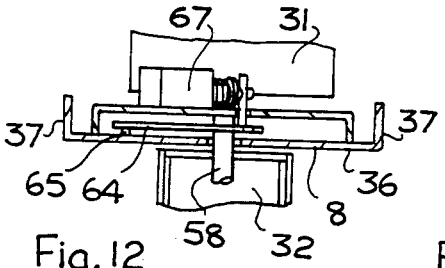
FIG. 12 is a sectional view of the portion of the towel dispenser of FIG. 1.
Figure 15:
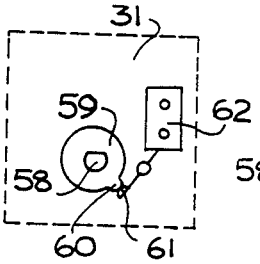
FIG. 15 is an elevational view of a detail of the dispenser of FIG. 1.
Figure 16:
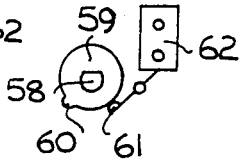
FIG. 16 is an elevational view of the detail of FIG. 15 in a different position.
Figure 13:
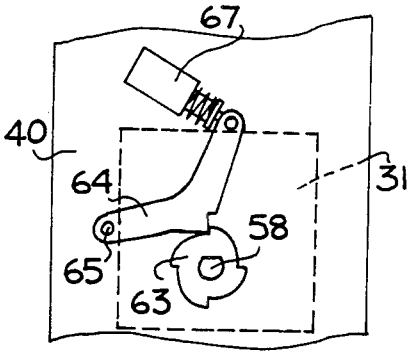
FIG. 13 is an elevational view of portion of the towel dispenser of FIG. 1.
Figure 14:
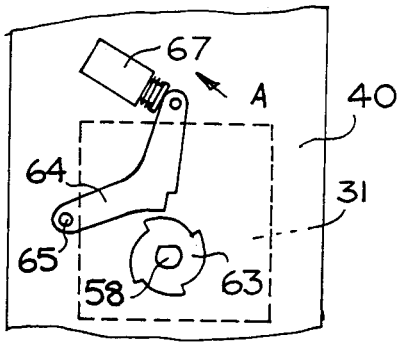
FIG. 14 is an elevational view of the portion of FIG. 13 is a different position.

The base 9 as can be most clearly seen in FIGS. 5 and 6 is formed from a pair of members 41 and 42 extending between the front and rear walls 7 and 8 and are secured thereto by welding. The member 41 is of substantially channel shape construction, having a main web 43 joining side webs 44 and 45. The side web 45 extends upwardly towards the pinch roller 33 for a purpose to be described below. The member 42 also has a channel shaped portion 46 and a side web 47 extends upwardly and is bent at 48 to form portion 49 of the skid plate 24. A second portion 50 of the skid plate 24 is secured by rivets 51 to the plate 50. As can be seen the outlet slot 16 is formed between the side webs 44 and 47 of the members 41 and 42 respectively. The inlet slot is formed by the side web 45 of the member 41 and a web 52 of a channel member 53 provided on the side panel 12.

A plate member 94 in combination with the web 45 and a hinged plate 95 extending between the front and rear walls 7 and 8 effectively form two compartments in the housing 6, namely a used towel compartment 96 and a clean towel compartment 97. This prevents contamination of the clean towel by the used towel. The plate member 94 is cranked at 98 and a downwardly directed portion 99 supports hinges 100 which pivot the plate 95. The hinged plate 95 also acts in combination with a microswitch 101 to form a trip means to de-activate the motor 30 of the take up roller 26 when a used towel loop has been completely withdrawn into the housing 6. This is described below.

Dealing now in more detail with the drive and pinch rollers 32 and 33, with particular reference to FIGS. 11 to 17, the drive roller 32 comprises a cylindrical member 54 with an outer roughened coating 55 to grip the towel. End caps 56 at each end support the roller 32 on shafts 57 and 58. The shaft 57 is rotatable in a bearing (not shown) in the front wall 7. The shaft 58 extends from the motor 31 and through a bearing (not shown) in the rear wall 8. Each time a fresh towel loop is required, the drive roller 32 dispenses a predetermined quantity of clean towel. This is achieved by counting the number of revolutions the drive roller makes, and then de-activating the motor. In this particular embodiment of the invention, the drive roller 32 is rotated for three revolutions. A cam member 59 with a projection 60 on its profile engages a cam follower 61 of a micro-switch 62. The cam member 59 is fast on the shaft 58. The micro-switch 62 is connected to the control circuitry (not shown) and on being tripped three times, the control circuitry deactivates the motor 31. A ratchet 63 and pawl 62 are also provided to prevent the drive roller 32 being further rotated after the motor has been de-activated to prevent the user pulling down additional towel from the clean towel roll. The ratchet 63 is fast on the motor shaft 58, and the pawl 64 is pivotally mounted on the support plate 40 by a pivot pin 65. A solenoid 67 also mounted on the support plate 40 pivots the pawl 64 in the direction of the arrow A to clear the ratchet 63 so that the motor 31 can drive the drive roller 32. When the motor 31 has been de-activated, the solenoid 67 is also de-activated, thereby releasing the pawl 64 to re-engage the ratchet 63. See FIGS. 10 and 11.

The pinch roller 33 terminates in shafts 68, which engage a pair of U-shaped brackets 69 in the front and rear walls 7 and 8 respectively. The pinch roller 33 bears on the drive roller 32 under its own weight. However, it is raisable in the brackets 69 away from the drive roller 32 to facilitate hand feeding of a new clean towel roll, Turning now to the take up roller 26, this is illustrated in detail in FIGS. 7 to 10. The take up roller 26 comprises a cylindrical member 70 with end caps 71 and 72. The roller 26 is releasably supported in the housing 6 by a motor shaft 73 of the electric motor 30 and a stub shaft 74 slidable in the front wall 7. The motor shaft 73 terminates in a member 75 which is fast with the shaft 73. A recess 76 of square cross section is provided axially in the member 75. A keying means in this case provided by an elongated keying member 77 slidable in the end caps 71 and 72 keys the roller 26 to the motor shaft 73. The keying member 77 as can be seen, extends the length of the take up roller 26 and is of square section to engage the recess 76 and a square section hole in the end cap 72. A compression spring 78 extending between the end cap 72 and a washer 79 fast on the member 77 biases the member 77 in the direction of the arrow C. A second washer 80 also fast on the keying member 77 abuts a stop member 81 in the cylindrical member 70 to limit travel of the keying member 77. The end 82 of the keying member 77 is of circular section to be slidable in an opening 83 in the end cap 71. The stub shaft 74 on being moved in the direction of the arrow B engages the opening 83 in the end cap 71 to rotatably support the roller 26 and simultaneously urges the keying member 77 against the spring 78 into engagement with the recess 76 in the motor shaft 73.

The stub shaft 74 terminates in an enlarged cylindrical portion 84 which is slidable in the outer panel 34 of the front wall 7. A compression spring 85 acting between the inner panel 35 and a flange 86 on the cylindrical portion 84 biases the stub shaft 74 in the direction of the arrow D. A pin 87 transversely mounted in the stub shaft 74 retains the stub shaft in the position illustrated in FIG. 9 so that it engages the end cap 71 of the roller 26. The pin 87 bears on the inner face of the inner panel 35, as can be seen in FIG. 9, thereby retaining the stub shaft 74 in the position illustrated in FIG. 8. Rotating the stub shaft 74 through 90° aligns the pin 87 with corresponding slots 88 to release the shaft 74 from the roller 26. Portions of the slots 88 are illustrated in FIG. 7. A square section member 89 is provided in the cylindrical portion 84 of the shaft 74 to engage a key for rotating the shaft 74.

A ratchet 90 and pawl 91, see FIG. 7, are provided to prevent unwinding rotation of the take up roller 26. The ratchet 90 is fast on the member 75 and the pawl 91 is pivotally mounted by a pivot pin 92 to the support member 40.

An engagement means for engaging the used towel being wound up on the take up roller 26 is provided by an elongated engagement member 93 which extends the length of the roller 26. As can be seen the member 93 extends from the roller 26 substantially tangentially in a radial circumferential direction. Thus, by rotating the roller in the direction of the arrow E, the engagement members 93 engage the used towel, thereby tightly rolling it onto the roller 26. On slight rotation of the roller 26 in the opposite direction, namely the direction of the arrow F, the members 93 effectively disengage the towel, and thereby the roller can be slid out from the used towel roll.

Locating means provided by arcuate members 121 on the front and rear walls 7 and 8 locate the roller 26 in the housing to facilitate engaging the keying member 77 with the recess 76 in the shaft 73.

Figure 22:
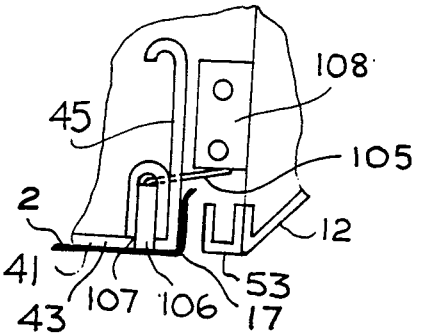
FIG. 22 is an elevational view of the portion of FIG. 21 in a different position.
Figure 3:
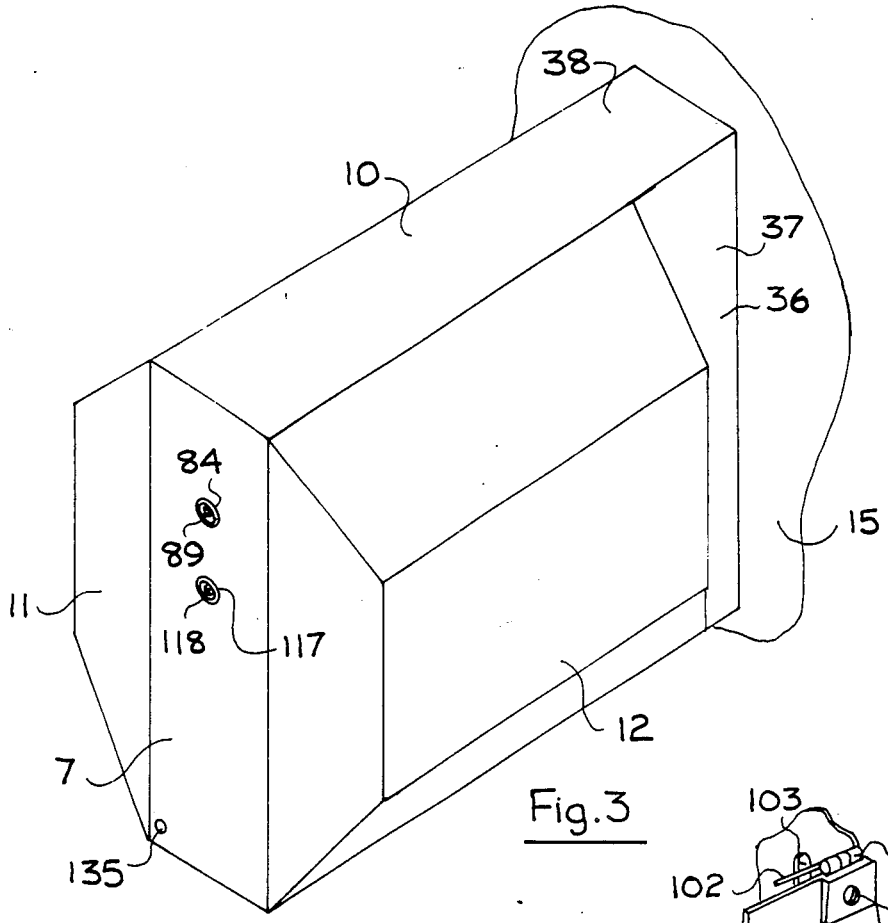
FIG. 3 is a top perspective view of the towel dispenser of FIG. 1.
Figure 18:
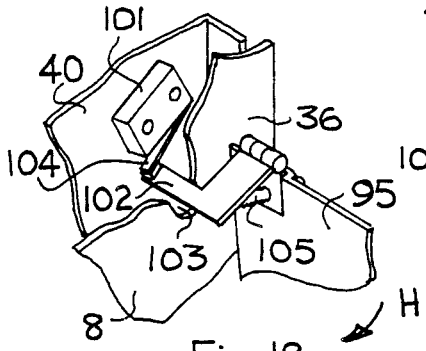
FIG. 18 is a perspective view of another detail of the dispenser of FIG. 1.
Figure 19:
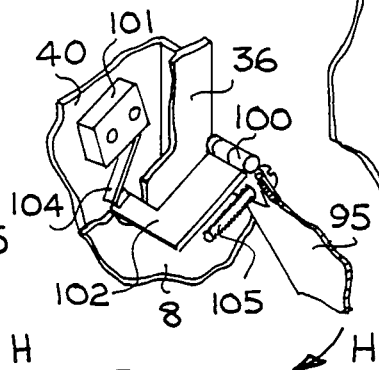
FIG. 19 is a perspective view of the detail of FIG. 18 is a different position.
Figure 20:
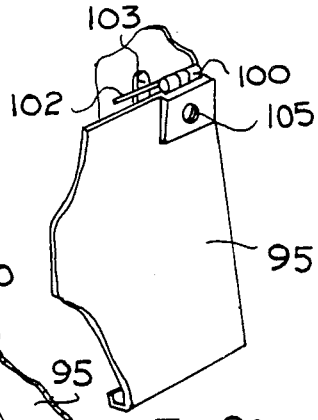
FIG. 20 is a perspective view of a further detail of the dispenser of FIG. 1.
Figure 4:
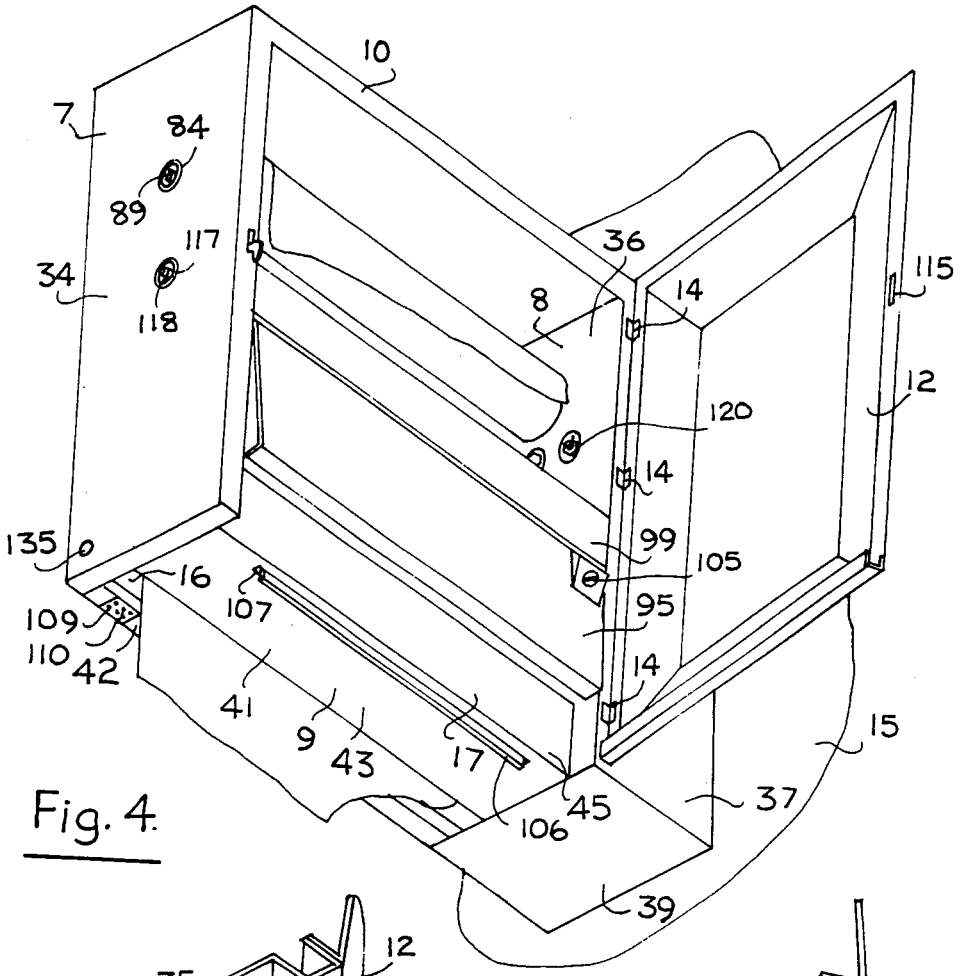
FIG. 4 is a further perspective view of the towel dispenser of FIG. 1.

Returning now to the trip means to trip the take up roller motor 30, the micro-switch 101 is mounted on the support plate 40, see FIGS. 18 to 20, and a member 102 extending from the hinged plate 94 and through an opening 103 in the rear wall 8 engages a follower 104 of the micro-switch 101. As the hinged plate 94 is moved inwardly in the direction of the arrow H see FIGS. 5 and 6, under tension in the towel the micro-switch 101 is tripped, The micro-switch 101 is connected into the control circuit which receives a signal on tripping of the switch 101. An adjusting screw 105 is provided in the hinged plate 95 to adjust the position of the member 102 relative to the plate 95, thereby allowing the sensitivity to be adjusted. A second trip means provided by an elongated bar 106 extending through a slot 107 in the base member 41 which also activates a micro-switch 108 mounted on the support plate 40, see FIGS. 21 and 22. The bar 106 extends through the rear wall 8 to engage the follower 105 of the micro-switch 108. On the bar 106 being moved upwardly into the housing as illustrated in FIG. 22 under tension in the towel, the micro-switch 108 is tripped. This micro-switch 108 is also connected into the control circuit and when both switches 101 and 108 are tripped by tension in the towel, the motor 30 is de-activated. Thus, the motor 30 is not de-activated until both micro-switches 101 and 108 have been tripped. This avoids the problem which could arise if a user were to trip the bar 106.

An activating means to activate the motor 31 and in turn the drive roller 32 to dispense a clean towel loop is provided in this case by a photocell 109 and a light source 110 mounted in the base member 42. A user, on passing his hand beneath the photocell 109 activates the motor 31 to drive the drive roller 32.

Figure 23:
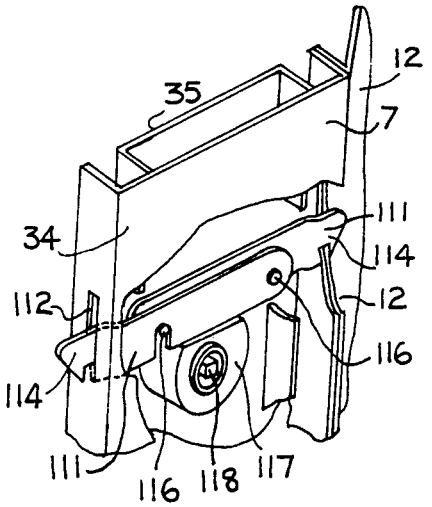
FIG. 23 is a perspective view of another detail of the dispenser of FIG. 1.
Figure 24:
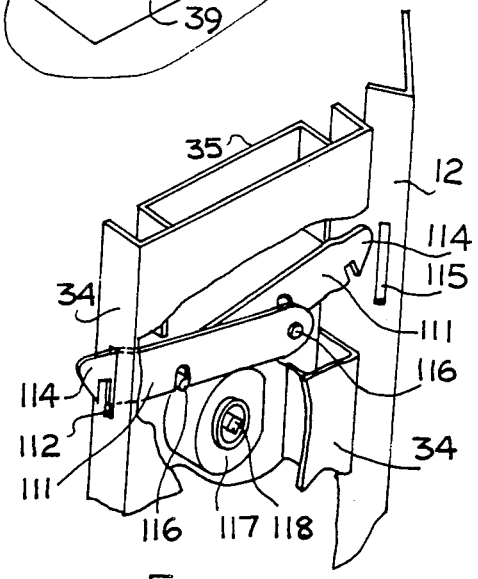
FIG. 24 is a perspective view of the detail of FIG. 23 in a different position.

Referring now to FIGS. 23 and 24, a locking means is illustrated for securing the side panels 11 and 12 in the closed position. The locking means comprises a pair of latches 111 which extend through slots 112 in the outer panel 34 of the front wall 7. Hooks 114 on the end of the latches 111 engage corresponding receiving slots 115 in the side panels 11 and 12. The latches 111 are pivoted on pivot pins 116. A cam member 117 rotatable in the inner and outer panels 34 and 35 raise and lower the latches 111 to engage the receivers 115. A square section member 118 for engagement by a key (not shown) extends from the camming member 117 and is accessible through the outer panel 34 of the front wall 7.

Mounting means for mounting the dispenser 1 to the wall 15 is provided by a mounting plate 125. The mounting plate comprises a pair of side flanges 126 with holes 127 to accommodate screws 128. A central portion 129 is raised from the flanges 126 and comprises key hole slots 130 to receive supporting screws 131 extending rearwardly from the dispenser 1. Four support members 132 are secured to and extend from the mounting plate 40 in the channel member 36 to support the screws 131. The screws 131 on engaging the support members 132 secure a cover plate 133 to the channel member 36. The heads 134 of the screws 131 are shaped can be seen in FIG. 27 to engage the key hole slots 130.

Manual override switches 120 are provided to allow the motors 30 and 31 to be manually operated for winding on a new clean towel roll.

A light indicator 135 is provided on the front wall 7 to indicate when a fault occurs in the dispenser.

In use, a clean towel roll is mounted on the skid plate 24. The towel may be of any material such as a reinforced paper web, a linen towel or the like. The free end of the towel is fed along the towel path illustrated in FIGS. 4 and 5, namely, between the drive and pinch rollers 32 and 33 through the outlet slot 16 and back in through the outlet slot 17, and the free end is then wound on to the take up roller 26, which is manually activated to wind on a small quantity of towel, so that the towel is wound tight as illustrated in FIG. 6. In other words, there is no towel loop showing. This is the normal position of the dispenser when not in use.

When a user requires a towel, he passes his hand beneath the dispenser to activate the photocell 109. This activates the dispenser to dispense the towel loop. Initially, the solenoid 67 is activated, so that the pawl 64 disengages the ratchet 63 on the drive roller shaft. The motor 30 then drives the drive roller 32 and a towel loop is dispensed through the outlet slot 16. On counting three revolutions of the drive roller 32, the motor 31 is de-activated. When the motor 31 is de-activated, the solenoid 67 is released and the pawl 64 re-engages the ratchet 63. A timer (not shown) in the control circuitry commences to time and after a predetermined period of time, the motor 30 is activated to drive the take up roller 26 which in turn takes up the used towel loop. When the used towel loop has been fully wound up, the tension in the towel activates the microswitches 101 and 108, thereby de-activating the motor 30 and stopping the take up roller 26.

To replace a used towel roll with a clean towel roll, the side panels 11 and 12 are opened. The stub shaft 94 is rotated through 90°, so that the transverse pin 87 disengages the inner panel 35 through the slots 88. The shaft 95 is thus withdrawn from the take up roller 26. This permits the keying member 77 under the spring biasing to disengage the recess 76 in the motor shaft 73. The take up roller 26 with the used towel roll is removed. The take up roller 26 is disengaged from the used towel roll by slight rotation of the roller 26 in the direction of the arrow F, see FIG. 7 and then sliding the roller 26 out through the core of the used towel roll. The take up roller 26 is then replaced in the housing 6 by first locating in the arcuate members 121, and then keying the roller 26 to the motor shaft 73 by moving the stub shaft 74 in the direction of the arrow B and rotating it through 90° so that the pins 87 engage the inner panel 35. A fresh towel roll is then placed on the skid plate 24 and fed through the dispenser as already described.

Figure 30:
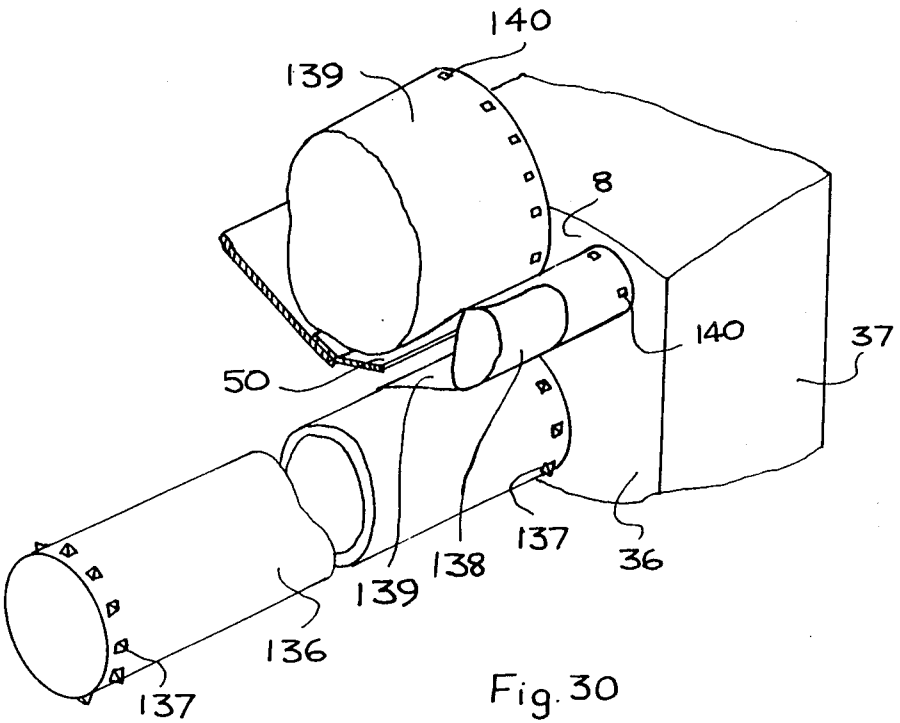
FIG. 30 is a perspective view of a towel dispenser according to another embodiment of the invention.
Figure 31:
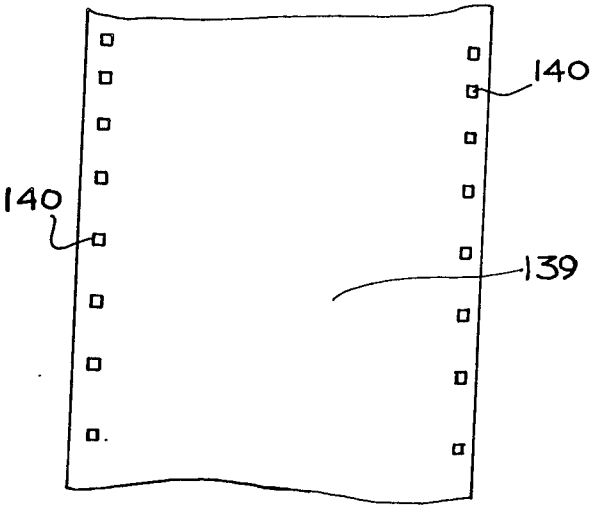
FIG. 31 is an elevational view of portion of a towel for sue in the dispenser of FIG. 30.

Referring now to FIGS. 30 and 31, there is illustrated portion of a dispenser according to another embodiment of the invention and a portion of a towel for use with this dispenser. This dispenser, in general, is similar to the dispenser described with reference to FIGS. 1 to 29, and similar components are identified by the same reference numerals. The only difference between this device and that just described is in the dispensing means, namely, the dispensing roller. In this case, the driver roller 32 has been replaced with a drive roller 136. Otherwise, the drive arrangement, the pawl and ratchet and the cam 59 and micro switch 62 are similar to the dispenser 1. The roller 136 is of cylindrical construction and comprises an engagement means to engage the towel positively. In this case, the engagement means is provided by a plurality of teeth 137 arranged at each end of the roller. A guide roller 138 replaces the pinch roller and guides the towel from the skid plate 50 onto the drive roller 136. As can be seen in this case, the guide roller 138 is spaced apart from the roller 136, although needless to say, if desired, it could be mounted substantially adjacent the roller 136 to keep the towel pressed onto the roller 136. In such a case, it will be appreciated that the roller 138 would extend along the drive roller 136 between the teeth 137. FIG. 31 illustrates a portion of a continuous towel 139 fed from a clean towel roll. As can be seen in this case, the towel 139 comprises a plurality of openings 140 on each side to engage the teeth 137. Thus, as the drive roller 136 is rotated, the towel 139 is dispensed to form a towel loop 2.

The advantage of the drive roller described according to this embodiment of the invention is that the towel is positively engaged, and there is no danger of the possibility of slip between the roller and the towel.

Figure 32:
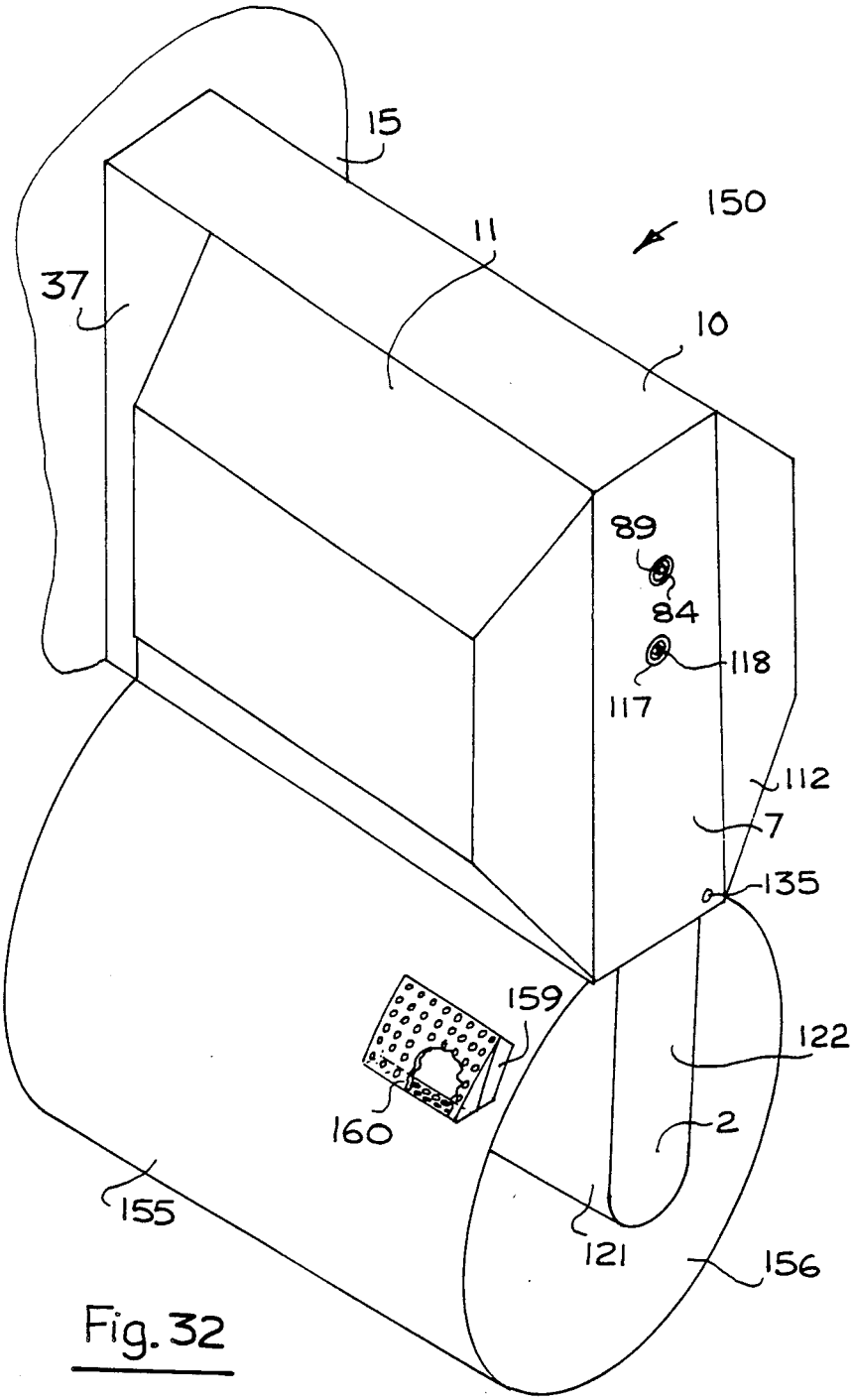
FIG. 32 is a perspective view of a towel dispenser according to another embodiment of the invention.

Referring now to FIG. 32, there is illustrated a towel dispenser indicated generally by the reference numeral 150 according to another embodiment of the invention. This dispenser is substantially similar to that described with reference to FIGS. 1 to 29, and similar components are identified by the same reference numerals. The main difference between this dispenser and the dispenser 1 is that a warm air dryer is also incorporated in the dispenser. A housing 155 forms a hand drying compartment 156 into which the towel loop 2 extends downwardly from the housing 6. A warm air blower 159 which comprises an electrical heating element and an air blower motor neither of which are illustrated is mounted on the housing 155. Warm air from the blower 159 is directed into the compartment 156 towards the towel loop 2. The warm air further facilitates hand drying. The compartment 156 is shaped so that the warm air circulates around the compartment. Some of the warm air is recirculated by the blower 159 and fresh make up air is drawn in through an air inlet 160 in the housing 155.

In this case an activating photocell (not shown) responsive to the users hands is provided in the compartment 156. Thus, on a user inserting his hands in the compartment the dispenser commences to operate by first dispensing a clean towel loop 2 into the compartment 156, and then activating the warm air blower 159. After a predetermined time, the towel loop 2 is rewound and the warm air blower 159 is de-activated. Otherwise the operation of this device is similar to the towel dispenser 1 just described.

Figure 33:
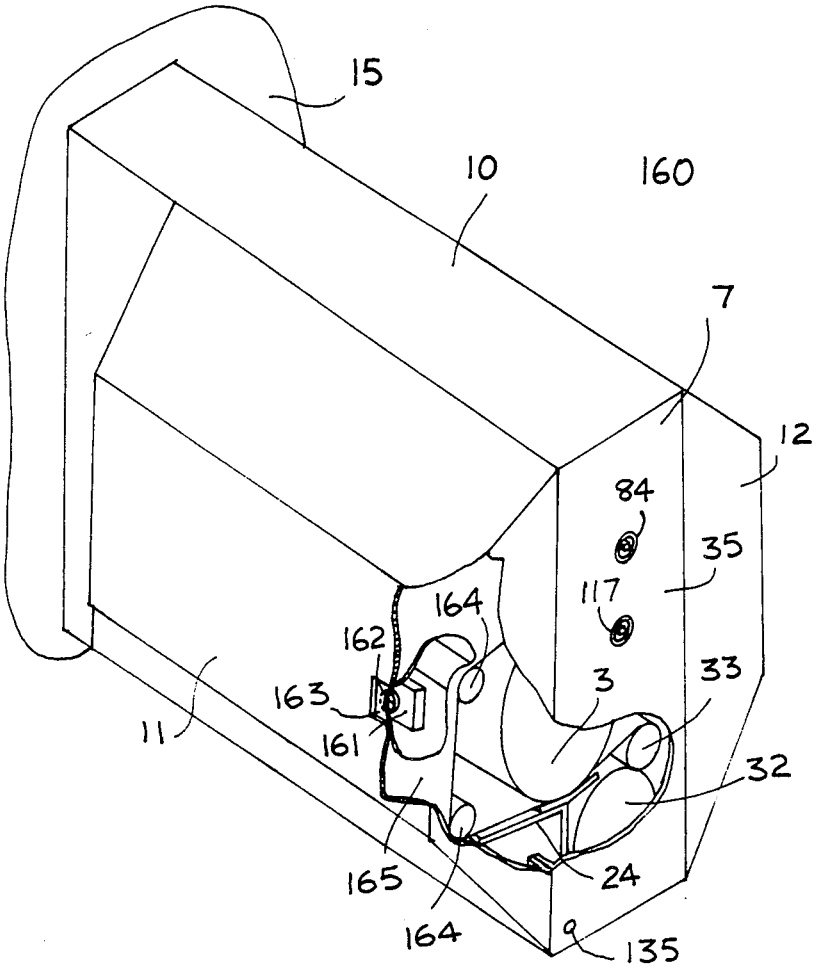
FIG. 33 is a perspective view of a towel dispenser according to another embodiment of the invention.

Referring now to FIG. 33, there is illustrated a dispenser according to a still further embodiment of the invention, indicated generally by the reference numeral 160. This dispenser is substantially similar to the dispenser 1 of FIGS. 1 to 29, and similar components are identified by the same reference numerals. The main difference between this dispenser and that of FIG. 1 is that in this case, the dispenser is activated by a manually operated switch 161 having a push button 162. The switch 161 is mounted on a bracket (not shown) connected to a suitable anchorage within the housing 6. An opening 163 is provided in the wall of the panel 11 to permit access to the button 162 of the switch 161. A pair of guide rollers 164 rotatably mounted in the housing in bearings (not shown) guide the towel 165 from the clean towel roll 3 between the push button 162 and the wall of the panel 11. The advantage of this is that a user never actually touches the button 162 with his hands, rather he presses the button 162 through the towel 165. Thus, contamination of the button 162 by unwashed or partly washed hands is avoided. The button is provided in such a position that the towel dispensed in each operation is of such a length that the portion of the towel pressed by the user to activate the dispenser is dispensed in that particular operation. Thus, any contamination which would have taken place is on the portion of the tyre 165 which is presented to the user to dry his hands. Needless to say, a fresh portion of towel is provided adjacent the push button 162 for the next user. Otherwise, operation of this device is similar to that described with reference to FIGS. 1 to 29.

Thus, the advantage of this particular feature of the invention is that it avoids any contamination of any part of the dispenser which could arise from badly washed or unwashed hands.

It will be appreciated that while particular storing means and particular take up means have been described any suitable storing or take up means could be used. For example, the clean towel roll could be stored on a shaft, which in certain cases, may be driven, and where it is driven, it is envisaged that the shaft would act as a dispensing means, thereby eliminating means for a drive and nip roller arrangement. Needless to say, other suitable dispensing means besides drive and nip rollers could be used. Indeed, in certain cases it is envisaged that the clean towel roll could be mounted on a freely rotating roller, and the dispensing means could be provided by a drive roller, which would bear on the outer periphery of the towel roll to rotate it, thereby dispensing a fresh towel loop. In this case, the length of loop dispensed could be controlled by counting the number of revolutions of the towel roller, or alternatively the number of revolutions of the drive roller driving the towel roll. Indeed, any other suitable means of monitoring the length of towel dispensed could be provided.

Other forms of take up means could also be used. For example, in certain cases, it is envisaged that the towel may be taken up by a drive nip roller arrangement. In another case it is envisaged that the used towel roll may be mounted on a rotatable shaft and the used towel roll would be driven by means of a drive roller bearing on the outer periphery of the used towel roll. Indeed, in certain cases, it is envisaged that the used towel, instead of being taken up on a towel roll, could be collected in a compartment into which it would be dispensed by continuous overlapping.

While the dispenser has been described for completely withdrawing a used towel loop in the housing, this is not necessary, in certain cases, the dispenser could be arranged to leave a towel loop depending therefrom at all times. In which case, it is envisaged that the towel dispensing drive means would be connected to the take up drive means, so that as the towel was dispensed through the outlet slot, used towel would simultaneously be withdrawn through the inlet slot. Needless to say, it is will be appreciated by those skilled in the art that it is not necessary for the dispensing means and take up means to be driven by electric motors, they could be driven by any suitable means, indeed in certain cases it is envisaged that they would be manually operated by the user, either by an external lever arrangement or alternatively, by pulling on the exit leg of the towel loop. Needless to say, if desired, a single motor with suitable transmission means to drive both rollers could be provided.

It is envisaged in certain cases that instead of the inlet and outlet slots being slightly spaced apart as in the case of the embodiments of the invention just described, they could be provided virtually side by side, thereby the two legs of the towel loop would substantially touch each other. In certain other cases, it is envisaged that the inlet and outlet slots may be considerably more spaced apart. In fact, it is also envisaged in certain cases that it is not necessary for the inlet and outlets slots to be provided in the base, they could be provided at either side of the dispenser if desired or any other suitable location. Additionally, while the inlet and outlet slots have been described as being substantially parallel to this other, this is not necessary, they could in certain cases be provided at an angle to each other. The important thing is that they should be arranged in such a position that each leg of the towel loop is substantially in line with the user.

It will also be appreciated that while certain control circuitry has been used to operate the apparatus, any other suitable control circuitry could be used. Needless to say, other trip means besides micro switches and the arrangement of the micro switch could be used without departing from the scope of the invention. It will also of course, be appreciated that while two trip micro switches have been provided to monitor tension in the used towel when taken up, one trip means would be adequate.

Additionally, it will be appreciated that stop means other than the ratchet and pawl described could be provided to prevent a user pulling excessive towel from either the clean towel roll or the take up roller.

It will also of course be appreciated that any other suitable means for dispensing a predetermined length of towel besides counting the number of revolutions could be used. For example, a timing arrangement could be used. Where a counting means is used, any other suitable means besides that described could be provided.

It will also, of course, be appreciated that while a particular construction of dispenser has been described which incorporates a warm air drying means with the towel loop, any other suitable construction of warm air arrangement could be used. For example, in certain cases it is envisaged that the drying compartment could be dispensed with altogether and the warm air would merely be directed at the towel loop. In certain cases it is envisaged that the warm air may be blown down between the two legs of the towel loop. Similarly, it will be appreciated that it is not necessary for the warm air to be recirculated through the air blower, fresh air could be continuously drawn in.

Needless to say, although the dispensing roller in the embodiment of the invention described with reference to FIG. 30 has been described as being provided with engagement which in this case are described as teeth, any other suitable engagement means for engaging the towel could be provided. For example, instead of using two sets of teeth at each end of the roller, one set would be adequate at one end only. Indeed in another case, it is envisaged that the set of teeth may be provided intermediate the ends of the drive roller, and preferably somewhere along the centre of the drive roller. Also, it will be appreciated that it is not necessary for the teeth to extend completely around the drive roller, they need only extend around portion thereof. In which case, the openings 140 in the paper could be provided along a continuous line or intermittently as desired. Needless to say, any other suitable engagement means for engaging the towel could be used.

It is also envisaged that in certain cases similar towel engaging teeth would be provided on the take up roller.

Needless to say, it will be appreciated that while a particular construction of housing has been described any other suitable construction could be used without departing from the scope of the invention.

It is envisaged in certain cases that the plate member for dividing the used towel roll compartment and the clean towel roll compartment could be dispensed with.

Needless to say, while the used towel take up roller has been described as being releasably engagable with the housing, while this is preferable, it is not essential. Indeed, it is will be appreciated that many other releasable mounting arrangements would be provided to releasably mount the take up roller.

Additionally, it is envisaged that the motors for driving the drive roller and the take up roller could be mounted in any other suitable location. In fact, in certain cases, it is envisaged that they may be mounted within the housing between the front and rear walls. This would have the advantage that it would shorten the length of the dispenser from front to back. In another case, it is envisaged that they may be mounted adjacent the top wall. Needless to say, in both cases it is envisaged that chain drives would be used to drive the respective rollers. In fact, in certain cases, it is envisaged that a single motor may be used, and again, suitable transmission means such as chain drives, belt drives, or the like could be used. Needless to say, where two motors are used, any suitable transmission means could be used, such as gears, belts, chains, or the like.

In another case, it is envisaged that the dispensing means could be provided by a motor to drive the towel roll. In which case, the roll on rotation would dispense clean towel from the clean towel roll. The clean towel roll could be mounted on a shaft extending axially through the clean towel roll, and on rotation of the shaft, the clean towel roll would rotate. Another alternative would be to mount the roll on a pair of spaced apart rollers, where the circumference of the towel would rest on the rollers, one or both of the rollers could be driven to rotate the clean towel roll to dispense clean towel. Alternatively, the clean towel roll could be mounted on a rotatable shaft, and a drive roller bearing on the circumference of the clean towel roll could be used to drive the clean roll for dispensing clean towel. Needless to say, other suitable arrangements could be provided without departing from the scope of the invention, and such arrangements will be readily known to those skilled in the art.

It will also of course be appreciated that in the embodiment of the invention described with reference to FIG. 33, any suitable switch besides a button switch could be used. Needless to say, the switch could be provided in any suitable location and any other suitable guide means for guiding the towel between the dispenser wall and the switch could be used.

We claim:

1. A towel dispenser of the type for dispensing a continuous towelling web in the form of a loop (2), having an exit leg (21) extending from the dispenser, and a return leg (22) extending into the dispenser, the towel dispenser comprising:

a housing (6) including a front member (7), a rear member (8) spaced apart from the front member, mounting means (125) for mounting the dispenser to a wall or other structure with the rear member adjacent the wall or other structure, a towel outlet (16) through which the exit leg of the towel loop extends, and a towel inlet (17) through which the return leg of the towel loop extends, the towel outlet and towel inlet extending between the front member and the rear member so that in use, the plane of each towel leg is perpendicular to the wall or other structure and in line with the user, storing means (24) in the housing to store a clean towel roll (3), dispensing means (32, 33) in the housing to dispense the towel through the towel outlet, and take up means (26) in the housing to take up used towel into the housing through the towel inlet.

2. A dispenser as claimed in claim 1 in which the towel outlet and towel inlet are provided by elongated slots extending substantially between the front and rear members.

3. A dispenser as claimed in claim 1 in which the front and rear members individually comprise front and rear walls.

4. A dispenser as claimed in claim 1 in which the take up means takes up substantially all of the used towel loop into the housing after use.

5. A dispenser as claimed in claim 1 in which the take up means is provided by a take up roller releasably mounted in the housing and driven by an electrically powered motor, and keying means releasably connects one end of the take up roller to the motor shaft, a stub shaft in the front wall releasably and rotatably engaging the other end of the take up roller.

6. A dispenser as claimed in claim 5 in which the keying means is provided by an elongated keying member coaxial with and slidable longitudinally in the take up roller, and movable from a position within the roller to a position extending from the roller to engage an axial recess in the motor shaft.

7. A dispenser as claimed in claim 6 in which the stub shaft is movable longitudinally to rotatably engage a bore in the take up roller, and to engage the keying member so that as the stub shaft engages the bore, the keying member is urged to engage the motor shaft.

8. A dispenser as claimed in claim 5 in which locating means are provided on the front and rear wall to locate the take up roller prior to interengaging of the keying means.

9. A dispenser as claimed in claim 5 in which engagement means are provided on the take up roller to engage the towel for winding on, the engagement means being arranged so that on rotation of the take up roller in one direction, the towel is gripped by the roller, while on slight rotation in the other direction the towel is effectively released from the roller.

10. A dispenser as claimed in claim 8 in which the engagement means are provided by at least one member extending tangentially from the circumference of the take up roller in a radial circumferential direction.

11. A dispenser as claimed in claim 1 in which trip means are provided to de-activate the take up means, the trip means being responsive to tension in the towel between the dispensing means and the take up means.

12. A dispenser as claimed in claim 10 in which a pair of trip means are provided, one being provided between the towel outlet and towel inlet, and the other being provided between the towel inlet and the take up means.

13. A dispenser as claimed in claim 1 in which the dispensing means is provided by a cooperating drive and pinch roller to dispense the towel therebetween, and a monitoring means to monitor when a predetermined length of towel has been dispensed is provided and the storing means comprises a skid plate mounted in the housing for supporting a clean towel roll in rolling rotation.

14. A dispenser as claimed in claim 1 in which a mechanically operated activating switch to activate the dispenser is mounted in the housing, an access opening being provided in a wall of the housing to allow access to the switch, guide means being provided in the housing to guide the towel between the switch and the housing wall adjacent the access opening.

15. A dispenser as claimed in claim 1 in which the towel loop extends in use into an enclosed compartment having an opening to provide access to the towel loop.

16. A dispenser as claimed in claim 1 in which a warm air generating means is provided to blow warm air at or adjacent the towel loop in use.

17. A dispenser as claimed in claim 1 in which engagement means are provided on the dispensing means to engage complementary engagement means on the towel.

18. A dispenser as claimed in claim 17 in which the engagement means is provided by a plurality of teeth extending at least partly around the drive roller.

19. A dispenser as claimed in claim 18 in which the engagement teeth are provided at each end of the drive roller.

20. A dispenser as claimed in claim 17 in which the towel roll is formed by a continuous towelling web, the web comprising a plurality of openings to engage corresponding engagement means on the drive roller.

* * * * *